United States Patent [19]

Dalzell

[11] Patent Number: 4,875,201

[45] Date of Patent: Oct. 17, 1989

[54] ELECTRONIC PULSE TIME MEASUREMENT APPARATUS

[75] Inventor: David T. Dalzell, Shiplake, England

[73] Assignee: Logic Replacement Technology, Limited, Berkshire, England

[21] Appl. No.: 222,413

[22] Filed: Jul. 21, 1988

[30] Foreign Application Priority Data

Jul. 21, 1987 [GB] United Kingdom ..... 8717173

[51] Int. Cl.[4] ..... G04F 8/00

[52] U.S. Cl. ..... 368/120; 368/117

[58] Field of Search ..... 368/113–120

[56] References Cited

U.S. PATENT DOCUMENTS

| | | | |
|---|---|---|---|
| 2,831,162 | 1/1958 | Gross | 324/68 |
| 2,905,887 | 6/1959 | Taddeo | 324/68 |
| 2,939,002 | 4/1960 | Giullon et al. | 250/27 |
| 2,942,194 | 5/1960 | Brennan | 328/112 |
| 3,034,048 | 10/1962 | Rogers | 324/68 |
| 3,068,405 | 9/1962 | Glazer et al. | 324/68 |
| 3,204,180 | 7/1965 | Bray et al. | 324/68 |
| 4,433,919 | 2/1984 | Hoppe | 368/120 |
| 4,439,046 | 10/1984 | Hoppe | 368/120 |

FOREIGN PATENT DOCUMENTS

| | | |
|---|---|---|
| 0163034 | 6/1985 | European Pat. Off. . |
| 1071-974-A | 11/1984 | U.S.S.R. . |

*Primary Examiner*—Bernard Roskoski

*Attorney, Agent, or Firm*—Nixon & Vanderhye

[57] ABSTRACT

Time measurement apparatus comprising a delay line having a plurality of taps, each tap having an associated latch. An inverting AND gate has its output connected to an initial tap of the delay line, an input signal having two conditions connected to one of its inputs, and has its other input connected to a later tap of the delay line.

The arrangement causes oscillation of the delay line in the presence of the first condition of the input signal. A counter counts the oscillations of the delay line, and the latches are caused to operate simultaneously on the second condition of the input signal.

The value stored in the counter and the pattern stored in the latches is used to derive the duration of the first condition.

12 Claims, 1 Drawing Sheet

MARCHING '1's AND '0's PATTERN

Figures 1, 2:
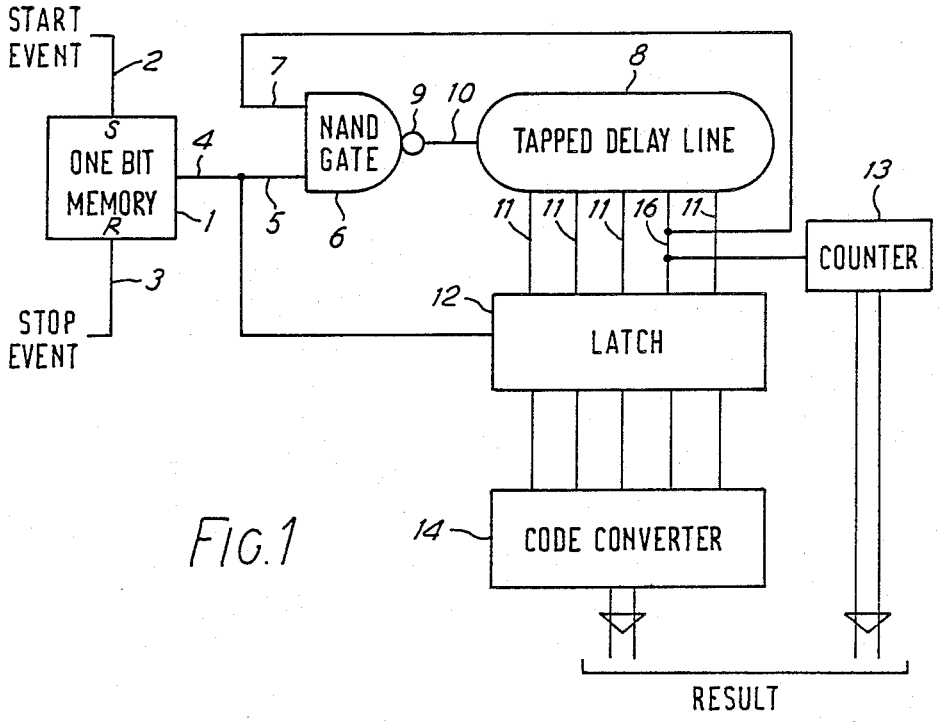

| T | PATTERN |
|---|---|
| 0 | 1 1 1 1 1 |
| 1 | 0 1 1 1 1 |
| 2 | 0 0 1 1 1 |
| 3 | 0 0 0 1 1 |
| 4 | 0 0 0 0 1 |
| 5 | 1 0 0 0 0 |
| 6 | 1 1 0 0 0 |
| 7 | 1 1 1 0 0 |
| 8 | 1 1 1 1 0 |

ELECTRONIC PULSE TIME MEASUREMENT APPARATUS

This invention relates to electronic apparatus for the measurement of time between non-repetitive events which may be expressed in terms of logic level transitions, for example to apparatus for the measurement of electronic pulse widths, and has particular application to apparatus for investigating electronic pulse signals in computer networks and the like. Conventionally, such measurements are normally carried out by purely digital means, and a number of techniques have been used. For signals which are of a repetitive nature, it has been possible to count the number of events which occur within a time window created by the measuring instrument. The frequency of the measured signal (and by reciprocation, its period) may thus be measured. The resolution of such systems is the ratio of the period of the measured signal to the duration of the internally created window. The precision of such systems is limited by the upper frequency limit of the counter used. The accuracy is related to the accuracy of the generated window.

Accuracy, resolution, and precision are separate considerations, and the factors which affect them are also somewhat different. The resolution of a system is generally used to specify the number of discrete values able to be reported by a measurement system, assuming that such values form a continuum. Sometimes, resolution is expressed as its reciprocal. For example, a resolution of one part in 100 is commonly referred to as a 1% resolution. The precision with which a measurement is made generally indicates the smallest value or change in value able to be reported by a measurement system. The accuracy of the system is a measure of the closeness of the true value of a parameter to that which is reported. Accuracy is often expressed as a percentage, or in terms of a range of the parameter being measured.

For non-repetitive signals, somewhat different arrangements have generally been used to determine the time elapse between two events of an incoming signal. In general, the initial event of the incoming signal may be used to start a counter, which counts events created by the instrument itself. These internal events will generally be the output of a reference oscillator. The finishing event in the incoming signal may be used to terminate the count. The number of counts in the counter is thus a measure of the time elapse between the specified two events in the incoming signal.

In this system, the precision, resolution and accuracy of the result are all related to the frequency of the reference oscillator of the measuring instrument. It is thus desirable to utilise as high a frequency as is possible for the oscillator, and that the frequency should be accurately known.

The physical constraints of current logic families generally limit the precision and resolution of current circuits to typically a small number of nanoseconds, for non-repetitive signals.

In accordance with the present invention, there is provided time measurement apparatus, for example apparatus for measuring pulse widths, comprising a delay line having a plurality of taps, a latch associated with each tap of the delay line, an inverting AND gate having an output connected to an initial tap of the delay line, means for connecting an input signal capable of indicating at least first and second conditions to a first input of the inverting AND gate, means connecting a later tap of the delay line with a second input of the inverting AND gate, thereby to cause oscillation of the delay line in the presence of the said first condition at the first input of the inverting AND gate, a counter for counting the said oscillations of the delay line, means for causing each of the latches to operate simultaneously on application of the second signal condition to the first input of the inverting AND gate, and means for deriving from the value stored in the counter and the pattern stored in the latches the duration of the first condition of the input signal.

The apparatus preferably includes means for an electronic memory device, (e.g. responsive to selected trigger events for example to the leading edges of pulses in a signal to be investigated (for measuring the time interval between pulses), or to the leading and trailing edges of pulses (for measuring pulse widths). The value stored in the memory device will in general change in accordance with the last signal received. Thus, in apparatus for measuring pulse widths, the leading edge of an input pulse would cause a "1" to be stored in the single bit memory, and the trailing edge of an input pulse would cause a "0" to be stored in the single bit memory.

The inverting AND gate may take the form of a single electronic component, having as one of its inputs the output of the memory device, and as the other of its inputs, the output from the said later tap of the delay line. Alternatively, the inverting AND gate may be constituted by the equivalent separate AND gate and separate invertor.

The effect of the connection of the output from the delay line to the NAND gate input is set up in the delay line a marching bit pattern, which initially consists of logic "1"'s until logic "1" is caused to appear on the second input to the NAND gate. At this point, the bit pattern of marching "1"'s is replaced by a pattern of marching "0"'s.

The delay line thus functions as an oscillator, once initiated by the presence of a logic "1" signal at the first input of the NAND gate, the period of the oscillation being related to the sum of the length of the delay line, up to the tap concerned, and the connection from the output of the delay line through the NAND gate.

A counter may be provided, connected to one of the taps of the delay line, to count the number of cycles of the system which occur between trigger events, and a code convertor (e.g. a look-up table in RAM or ROM) may be connected to the output of the latches, for producing an output indicative of the distance "travelled" along the delay line by the initiating trigger signal, on the arrival of the terminating trigger signal. This output, representing a fraction of the delay introduced by one cycle of the delay line oscillator, may be added to the value stored in the counter, representing an integral multiple of the delay introduced by one cycle of the delay line oscillator, to produce the overall time delay between the two trigger events.

Because the period of the oscillator will depend upon the tolerance to which the delay line is manufactured, and upon the particular characteristics of the NAND gate, a reference signal is preferably provided for calibration purposes, in order to enable the period of the oscillator to be determined accurately.

A preferred embodiment of the invention is described in the accompanying drawings, in which:

FIG. 1 is a schematic diagram of apparatus in accordance with the invention, for analysing signals in an electronic circuit, and FIG. 2 represents a bit pattern experienced in the apparatus of FIG. 1.

Referring first to FIG. 1, the apparatus comprises a one bit memory 1 having inputs 2 and 3 for a start event and stop event respectively. The start event and stop event are extracted from the input signal by other circuitry (not shown) of conventional form.

Output 4 from one bit memory 1 is connected to a first input 5 of a NAND gate 6. The second input 7 to NAND gate 6 is connected to a near ultimate output of a tapped delay line 8. The output 9 of NAND gate 6 is connected to the input 10 of tapped delay line 8.

Delay line 8 has a number of taps 11, 16 of which only five are shown, for clarity. In practice, the number of taps will generally be somewhat greater than this, and it has been found in particular that a ten-tap commercially available delay line is particularly suitable. Each tap 11, 16 is connected to the corresponding input of a latch 12, which may also be instructed to sample and hold its input by the output 4 of a one bit memory 1.

A counter 13 is connected to, for example, the seventh or eighth tap 16 of the delay line 8, to count the number of times that the marching pattern cycles between trigger events.

A code convertor 13 is connected to the respective outputs of the transparent latch 12.

The operation of the circuit is as follows. The circuit is initiated by the arrival of a start event at input 2 to one bit memory 1. This event sets the one bit memory 1 to logic "1", and thus provides an input of logic "1" to input 5 from NAND gate 6. Input 7 of gate 6 is initially at logic "1", and thus logic "0" propagates along delay line 8. At intervals dictated by the delay line tap spacing, the "0" signals from gate 6 arrive at the inputs of latch 12. When the "0" signal reaches the tap 16 to which counter 13 is connected, the counter 13 increments. At the same time, the "0" signal arrives at input 7 of NAND gate 6 via the "feedback" connection from tap 16 to input 7. It should be appreciated that although in the embodiment illustrated the feedback is taken from the same tap to which the counter is connected, in a alternative embodiment, different taps may be employed for these connections.

The arrival of logic "0" signal at input 7 causes output 9 of NAND gate 6 to change to logic "1", which now propagates along delay line 8. Thus, the circuit may be said to oscillate, the period of the oscillation being related to the sum of the length of the delay line 8 up to the feedback tap 16, and the delay introduced by NAND gate 6. Each cycle of the oscillator is counted by the counter 13.

When a stop event (derived from other circuitry, not shown) is received on input 3 to one bit memory 1, the latches 12 are instructed to sample their current inputs, thus retaining a "snapshot" of the instantaneous state of the marching "1"'s and "0"'s pattern. Because at most two bits in the pattern change at any instant, the latch pattern can introduce at most a one bit error.

The pattern held by the latch is converted to a monotonic binary pattern by means of a simple code convertor circuit 14. The time delay between the two trigger signals is then derived from the product of the value stored in counter 13 and the period of the delay line oscillator, plus the value derived from the code convertor.

The precision of the value represented by the resultant binary code is that of the inter-tap spacing of the delay line 8. The precision of the value residing in counter 13 is related to the period of the oscillator comprised by NAND gate 6 and the delay section line utilised 8.

Thus, it can be seen that the resolution obtained by the circuitry is controlled by the spacing of the delay line taps (typically one nanosecond in presently available circuity), but that no key signal in the circuit has a period of less than the delay line feedback circuit (typically 8 nanoseconds). Thus, the circuit may attain a high precision time measurement, without the need for a high frequency reference oscillator.

In principle, the feedback tap 16 to input 7 of the NAND gate 6 could be from the final physical tap of the delay line 8. In practice however, it is preferable to utilise a tap which is close to the end, for example the seventh or eighth tap of a ten-tap delay line. The purpose of this is to compensate for the delay introduced by the NAND gate 6.

Although in principle it is possible to calculate the overall delay of the oscillating loop, by adding the delay introduced by the individual taps of the delay line, and that introduced by NAND gate 6, in practice, the error which would be introduced in doing this would be substantial, because the tolerances of individual components would be additive. It is therefore preferable to provide a reference signal, of known pulse width, by which the device in accordance with the invention may be calibrated.

A circuit of the kind described above is of particular useful for measuring the quality of signals in a computer network, in which one factor which is of particular interest is the pulse width of signals on the network. Any suitable display means may be provided to enable the user to visualise the time feature (for example the pulse width) measured, such as, for example, a liquid crystal display, cathode ray tube, or the like. Alternatively the measured parameter may be used within an electronic instrument to help present some other parameter.

It will of course be appreciated that a large number of other detailed arrangements are possible, in addition to those specifically disclosed above.

I claim:

1. Time measurement apparatus comprising:

a delay line having an input tap and a plurality of further taps, a latch associated with each of the further taps of the delay line, an inverting AND gate having an output connected to the input tap of the delay line, means for connecting an input signal capable of indicating at least first and second conditions, to a first input of the AND gate, means connecting a later tap of the delay line with a second input of the inverting AND gate, thereby to cause oscillation of the delay line in the presence of the said first condition at the first input of the inverting AND gate, a counter for counting the said oscillations of the delay line, means for causing each of the latches to operate simultaneously on application of the second signal condition to the first input of the inverting AND gate, and means for deriving from the value stored in the counter and the pattern stored in the latches the duration of the first condition of the input signal.

2. Apparatus as claimed in claim 1, including an electronic memory device, and means for changing the value stored in the electronic memory device in accordance with selected trigger events.

3. Apparatus as claimed in claim 2, wherein the said memory device is a single bit memory.

4. Apparatus as claimed in claim 2, wherein the said selected trigger events include the leading edge of an input pulse and the trailing edge of an input pulse.

5. Apparatus as claimed in claim 2, wherein the delay between the said later tap and the final tap of the delay line corresponds to the delay introduced by the inverting AND gate.

6. Apparatus as claimed in claim 1, wherein the delay line includes about ten taps, and the said later tap is about the eight tap of the delay line.

7. Apparatus as claimed in claim 1, including means for fascillating the calibration of the oscillator constituted by the said delay line and inverting AND gate.

8. Apparatus as claimed in claim 1, including a code convertor connected to the output of the said latches.

9. A method as claimed in claim 9, wherein the apparatus includes an electronic memory device for storing a value associated with the said trigger events.

10. A method of determining the duration of a first condition of an input signal capable of indicating at least first and second conditions, which method comprises:

feeding the input signal to time measurement apparatus comprising:

a delay line having an input tap and a plurality of further taps, a latch associated with each of the said further taps of the delay line, an inverting AND gate having first and second inputs, and having an output connected to the input tap of the delay line, means connecting a later tap of the delay line with a second input of the inverting AND gate, to enable oscillation of the delay line, and a counter for counting the said oscillations of the delay line, such that the input pulse is applied to the first input of the AND gate, thereby causing the said oscillation of the delay line in the presence of the first condition of the input signal at the said input of the AND gate, causing the counter to count oscillations of the delay line, causing each of the latches to operate simultaneously on application of the second condition of the input signal at the first input of the inverting AND gate, and deriving from the value stored in the counter and the pattern stored in the latches the duration of the first condition of the input signal.

11. A method as claimed in claim 10, including storing a value associated with selected trigger events in an electronic memory device such that the said first and second conditions of the input signal correspond to different values stored in the electronic memory device.

12. A method as claimed in claim 10, including storing in an electronic memory device a value associated with selected trigger events which include a leading edge of an input pulse and a trailing edge of an input pulse such that the said first and second conditions of the input signal correspond to different values stored in the electronic memory device.

* * * * *